United States Patent [19]

Quigley

[11] 4,426,557

[45] Jan. 17, 1984

[54] SWITCH HOUSING STRUCTURE FOR CONNECTION TO SWITCH TERMINAL BOARD

[75] Inventor: Thomas J. Quigley, Newtown, Pa.

[73] Assignee: Continental-Wirt Electronics Corp., Southampton, Pa.

[21] Appl. No.: 340,353

[22] Filed: Jan. 18, 1982

[51] Int. Cl.[3] ..... H01H 15/02

[52] U.S. Cl. ..... 200/16 D

[58] Field of Search ..... 200/16 R, 16 B–16 F, 200/303, 292, 11 DA

[56] References Cited

U.S. PATENT DOCUMENTS

| | | | |
|---|---|---|---|
| 2,303,693 | 12/1942 | Hill | 200/16 C X |
| 3,461,252 | 8/1969 | Vananzi | 200/16 C |
| 4,072,839 | 2/1978 | Spedale | 200/303 X |
| 4,137,438 | 1/1979 | Sato et al. | 200/16 F X |
| 4,209,674 | 6/1980 | Kondo | 200/16 F X |
| 4,210,791 | 7/1980 | Sorenson | 200/303 X |
| 4,341,935 | 7/1982 | Josemans | 200/16 C X |

*Primary Examiner*—J. R. Scott

*Attorney, Agent, or Firm*—Ostrolenk, Faber, Gerb & Soffen

[57] ABSTRACT

A switch terminal board of insulation material has spaced contacts fixed on one surface thereof which recieve a sliding switch member. The housing body also contains a sliding contact, a bias spring for pressing the sliding contact toward the fixed contacts, and an operating handle. Parallel longitudinal edges of the terminal board are fitted into corresponding parallel, elongated slots in the housing to securely fix the terminal board against accidental displacement and dislodgement due to forces which tend to pull the board away from the housing. Central portions of the edges of the switch terminal board may be notched, and the housing material below the slots can be deformed into the notches to improve the securement of the terminal board within the housing.

3 Claims, 15 Drawing Figures

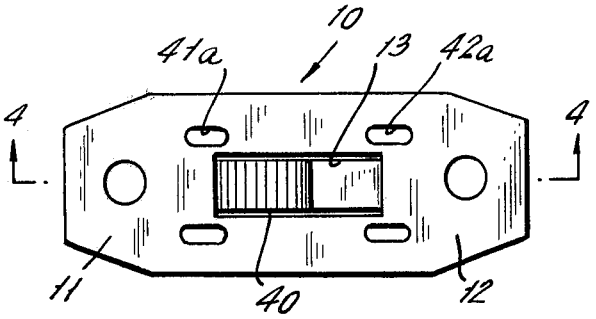
FIG. 2.
(PRIOR ART)
FIG. 1.
(PRIOR ART)
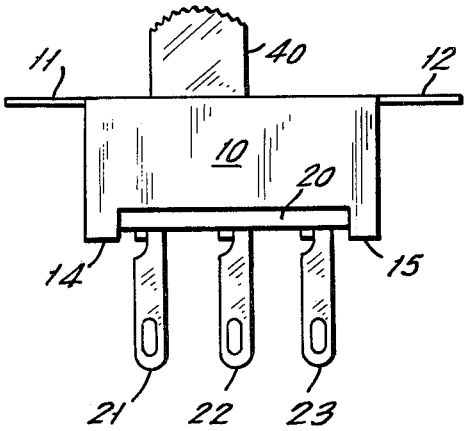
FIG. 3.
(PRIOR ART)
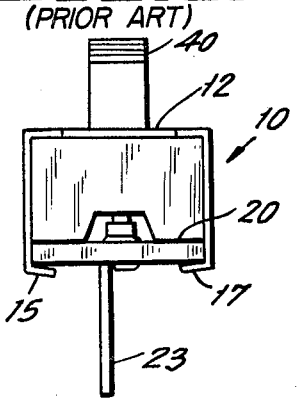
FIG. 4.
(PRIOR ART)
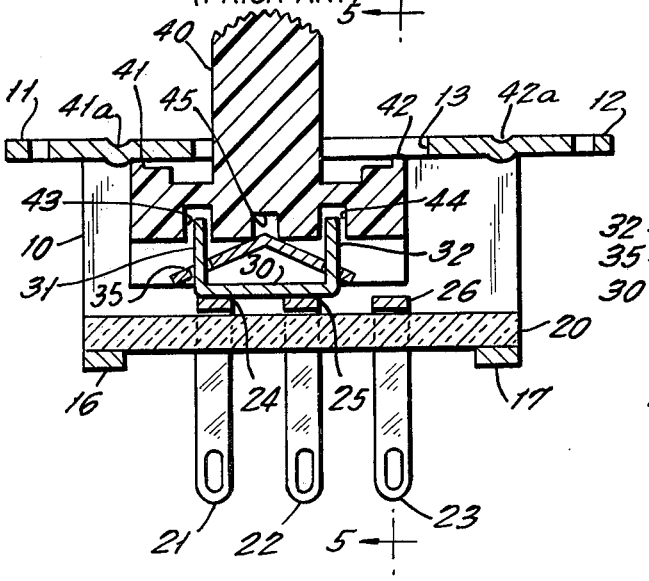
FIG. 5.
(PRIOR ART)
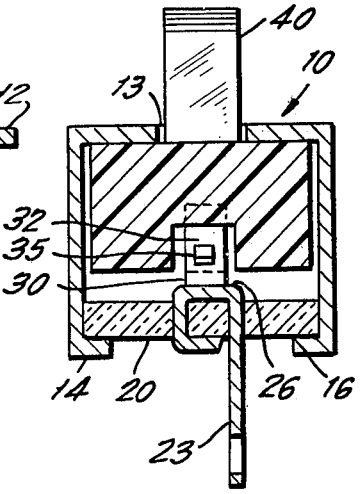

FIG. 6.
(PRIOR ART)
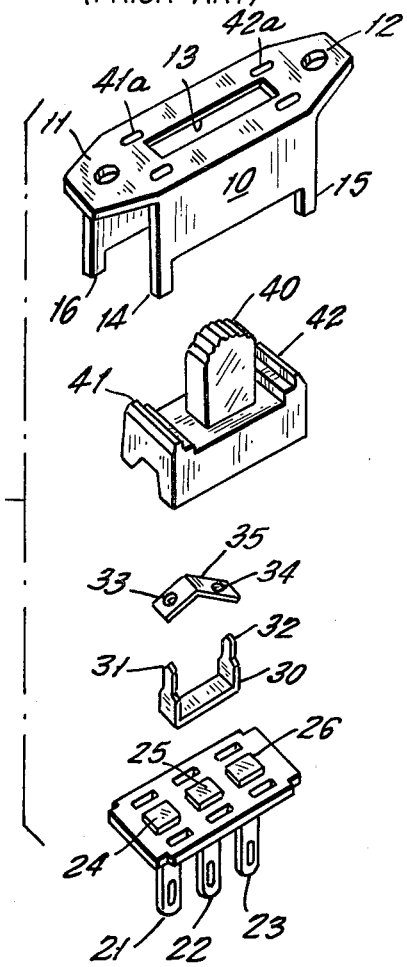
FIG. 8.
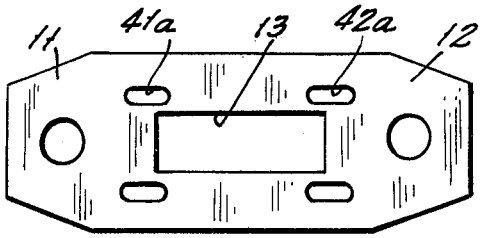
FIG. 7.
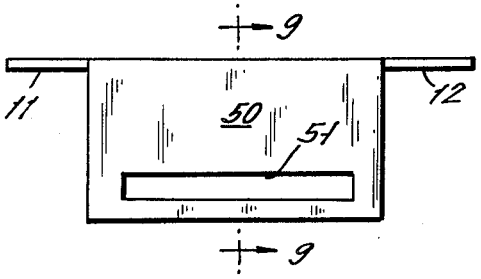
FIG. 9.
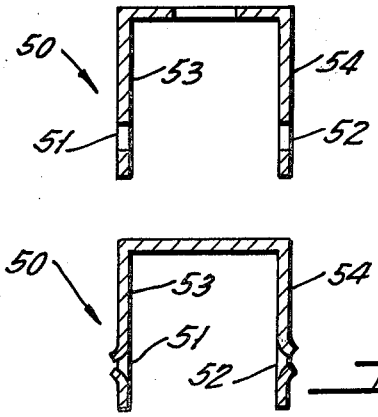
FIG. 10.
FIG. 11.
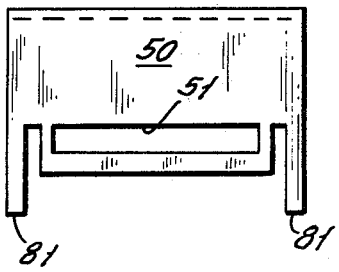

SWITCH HOUSING STRUCTURE FOR CONNECTION TO SWITCH TERMINAL BOARD

BACKGROUND OF THE INVENTION

This invention relates to switch structures, and more specifically relates to a novel manner for fixing a switch terminal board to a thin rigid material switch housing.

Inexpensive, relatively low power switches are well known wherein the stationary switch contacts are fixed to an insulation terminal board. Contact terminals extend through the terminal board to be accessible for connection to appropriate circuits through solder connection or a plug-in type connection. The terminal board is carried adjacent and within the open end of a generally U-shaped thin steel housing. The housing also receives a sliding contact which makes sliding contact with respect to the fixed contacts on the terminal board, and an operating handle which is accessible externally of the housing for moving the sliding contact relative to the fixed contacts. A biasing spring is also provided to ensure good contact between the sliding contact and the fixed contacts fixed to the switch terminal board. The terminal board is commonly attached to the switch housing by small metal tabs which extend from the bottom of switch housing and which are folded around the bottom of the ends of the switch terminal board. These same tabs also hold the entire switch assembly in its assembled condition.

Such switches are frequently mounted on a printed circuit board or other structure in which space is at a premium. Consequently, the switch should be as small as possible, and the thickness of the housing should be as small as possible.

It has been found that the terminal board can be dislodged or loosened relative to the steel housing by moderate forces which tend to pull the terminal board away from the housing. Thus, when the switch is soldered into a printed circuit board, and the handle projects through the housing, an excessive force or impact on the handle will pry open the tabs which fix the switch terminal board to its housing, causing the switch to break apart.

The same problem occurs when the switch is mounted by ears extending from the housing since applying a downward pressure to the handle will press the terminal board away from the housing, and will tend to pry open the mounting tabs.

While thicker steel could be used for the housing to increase the strength of the mounting tabs, space and cost is at a great premium and the thinnest possible steel should be used for the housing.

BRIEF DESCRIPTION OF THE INVENTION

In accordance with the invention, a novel thin steel generally U-shaped housing is provided with rectangular slots adjacent the free ends of the legs of the U, which slots receive respective edges of the switch terminal board. Thus, the switch terminal board is supported directly within the body of the steel casing rather than by tabs extending from the steel casing which bend under the switch terminal board. In this way, the tensile strength of the steel is employed to hold the board in place and the steel housing can be extremely thin, and, for example, less than about 25 mils. The use of very thin steel for the switch housing reduces the necessary size of the switch for printed circuit application or other applications which place emphasis on the small switch size and cost.

The parallel side edges of the switch terminal board which are received within slots in the legs of the steel housing may be notched to permit the steel housing material beneath the notch to be deformed into the notch in order to help fix the switch terminal board to the switch housing.

The rectangular slots formed in the switch terminal housing may also have their outer edges deformed outwardly of the plane containing the slot to simplify the assembly of the switch terminal board. The deformed material is returned to lie in the plane of its respective leg by a suitable tool after the switch terminal board is loaded into the slots in the housing legs.

BRIEF DESCRIPTION OF THE DRAWINGS

FIG. 1 is an elevation view of the side of a prior art type of switch.

FIG. 2 is a top view of FIG. 1.

FIG. 3 is a side view of FIG. 1.

FIG. 4 is a cross-sectional view of FIG. 2 taken across the section line 4—4 in FIG. 2.

FIG. 5 is a cross-sectional view of FIG. 4 taken across the section line 5—5 in FIG. 4.

FIG. 6 is an exploded perspective view of the parts shown in FIGS. 1 to 5.

FIG. 7 is an elevation view of the side of a housing constructed in accordance with the present invention.

FIG. 8 is a top view of the housing of FIG. 7.

FIG. 9 is a cross-sectional view taken across the section line 9—9 in FIG. 7.

FIG. 10 shows the view of FIG. 9 where the edges of the slots in the housing legs are outwardly deformed to simplify the insertion of a terminal board into the housing.

FIG. 11 is an elevation view of the side of a housing of a second embodiment of the invention.

DETAILED DESCRIPTION OF THE INVENTION

Figure 12:
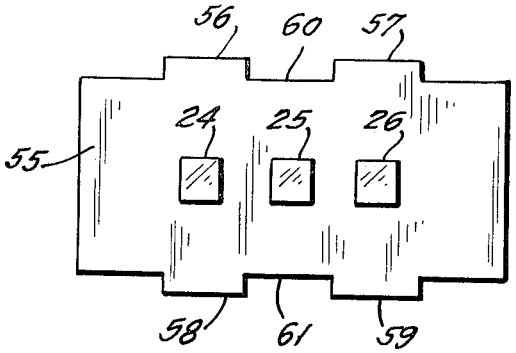
FIG. 12 is a top view of a switch terminal board modified in accordance with the invention for assembly into the switch housings of FIGS. 7 or 11.

Referring first to FIGS. 1 to 6, there is shown therein a typical prior art switch assembly for a switch rated at 125 volts and 3.0 amperes a-c or 0.5 amperes d-c. The switch is well suited for mounting on a printed circuit card. The switch is a three-terminal switch in which the central terminal may be connected to either of the housing terminals by the motion of a linearly sliding handle which is accessible as will be described. Note that while the present invention applies to this kind of switch, it also applies to switches having other terminal configurations and electrical ratings, and to different kinds of operating handles other than a sliding operating handle.

The switch consists of a steel housing 10 which is generally of U shape and consists of the thinnest possible steel so that the switch will take up the least possible room in a printed circuit board or other application. By way of example, the steel housing 10 can be stamped from a single sheet of steel having a thickness from 16 to 25 mils. The stamped sheet is then bent to the U shape shown.

Housing 10 may have extending mounting ears 11 and 12 which have respective mounting openings therein for mounting the housing to a suitable support surface. Housing 10 also has a handle-receiving slot 13 and extending tabs 14, 15, 16 and 17 which extend from the opposite ends of the two legs of the stamped housing, as shown in FIG. 6 for tabs 14, 15 and 16 which are shown in their open position. When the housing is assembled, tabs 14 to 17 are bent to the folded position shown in FIGS. 1, 3, 4 and 5. The total length of housing 10 (excluding ears 11 and 12) may be about 0.680 inch; its width, across the web or base of the U, may be about 0.410 inch; and its height may be approximately 0.400 inch, not including the lengths of the tabs 14 to 17.

A switch terminal board 20 of suitable insulation material is then fastened to the housing 10 by bending the tabs 14 to 17 beneath the four-corner regions of the board 20. The insulation board 20 may have a thickness, for example, of 0.075 inch.

A plurality of contact terminals 21, 22 and 23 are secured to the board 20 and may extend for about 0.25 inch below the bottom of the board 20. Terminals 21, 22 and 23 are of plated copper having any desired dimension and are located in appropriately aligned slots in the board 20 in a known manner. For example, the terminals can be secured to board 20 in the manner shown in copending application Ser. No. 336,626, filed Jan. 4, 1982, entitled "Terminal Staking Article and Process".

As shown in FIGS. 4, 5 and 6, the upper ends of terminals 21, 22 and 23 are bent over to present flat sections 24, 25 and 26, respectively, which are parallel to the upper surface of board 20 and act as stationary contact surfaces for the switch. The terminal members 21, 22 and 23 then continue from the flat sections 24, 25 and 26 and penetrate other pre-existing slots in the board and wrap around the board to be secured thereto as shown, for example, in FIG. 5 for the terminal 23. Clearly, other stationary contact configurations could be used, depending on the switch application.

The movable contact for the switch is shown as the stamped copper contact 30 which is a short, thin strap having perpendicularly turned ends 31 and 32. The ends 31 and 32 have a reduced cross-section and extend through aligned openings 33 and 34 of a prebent, flexible spring 35. Spring 35 provides contact pressure for pressing the sliding contact 30 into bridging and sliding engagement with contacts 24 and 25 or contacts 25 and 26.

The operating handle for the switch consists of the molded body 40 which has a portion thereof extending through the slot 13 in housing 10. Body 40 has a lower body region having bearing surfaces 41 and 42 which slide on the interior surface of the web of the U-shaped member 10. Note that suitable dimples, such as dimples 41*a* and 42*a*, are formed in the upper surface of the switch housing 10 and serve as stops for the lateral movement of the insulation member 40 within the switch.

The bottom of member 40 is provided with two openings 43 and 44 which receive contact ends 31 and 32, respectively. The bottom of insulation member 40 also has an elongated slot 45 which receives the apex of the bent spring 35. Thus, the contact 30 and the biasing spring 35 will move as a unit with the operating member 40.

The switch of FIGS. 1 to 6 is assembled by first fitting contact 30, spring 35 and handle 41 together with the extensions 31 and 32 positioned in the apertures 43 and 44, respectively. This assembly is then loaded into the housing 10, with a portion of member 40 projecting through aperture 13. The switch board 20 is then put in place at the bottom of the extending legs of housing 10 and the tabs 14 to 17 are bent to the position shown, thereby to fix together the components of the housing. The parts are so dimensioned that spring 35 will be pressed toward its open position so that it will exert a biasing force on the contact 30 which presses the contact 30 toward engagement with contact surfaces 24, 25 and 26.

In FIG. 4, contact 30 makes electrical contact between terminals 21 and 22. In order to open this connection, the operating member 40 is moved to the right, and to a position where contact 30 sits only atop contact surface 25. When the operating member 40 is moved fully to the right, the contact 30 will electrically engage both of contact surfaces 25 and 26 in order to connect together the terminals 22 and 23.

In switch structures of the kind shown in FIGS. 1 through 6, the printed circuit board 20 is fixed to housing 10 solely by the folded metal tabs 14 to 17. Since it is desired to have the switch as small as possible, the tabs are very thin and, consequently, it is possible to pry the tabs open by exerting a force which tends to pull the board 20 and the housing 10 apart. Such forces are frequently caused by operators pressing downwardly on the plastic member 40 or by gripping the housing 10 and pulling it upwardly in order to pull contacts 21 through 23 out of a plug-in connection.

In accordance with the present invention, a novel connection is made between a switch housing and switch terminal board which makes a much more rigid connection between the two and prevents their separation or loosening by presently expected forces which would tend to separate the board and the switch housing of the prior art switch.

A first embodiment of the novel switch housing of the invention is shown in FIGS. 7 to 10. Referring to those figures, the novel switch housing 50 has the same size as the one of FIGS. 1 to 6. However, housing 50 is provided with elongated, rectangular slots 51 and 52 in legs 53 and 54 respectively. The web, or base of the U-shaped housing also contains the slot 13 and the mounting ears 11 and 12, previously described.

Figure 13:
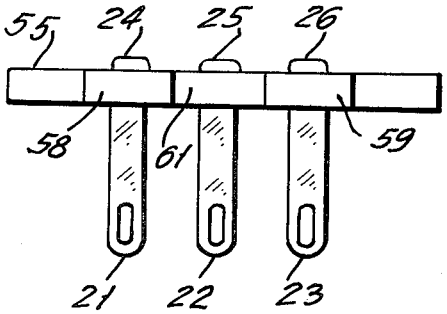
FIG. 13 is a front view of the switch terminal board of FIG. 12.

The switch terminal board 20 of FIGS. 1 to 6 is replaced by the novel terminal board 55 of FIGS. 12 and 13 which has the same thickness and overall size of terminal board 20 and also contains the terminals 21 through 23 of FIGS. 1 to 6. The board 55, however, is modified in shape by having extending edges of length equal to the length of slots 51 and 52 respectively, which are fitted within slots 51 and 52 respectively. These edges are defined in FIGS. 12 to 14 by extending tabs 56 and 57 along one edge of board 55 and extending tabs 58 and 59 along its opposite edge. A notch 60 separates tabs 56 and 57 and a notch 61 separates tabs 58 and 59.

In order to mount switch terminal board 55 in the housing 50, the tabs 56 and 57 are inserted into slot 52 and the tabs 58 and 59 are inserted into the slot 51. Note that the tabs 56 through 59 may have a depth at least equal to the thickness of the steel housing.

Figure 14:
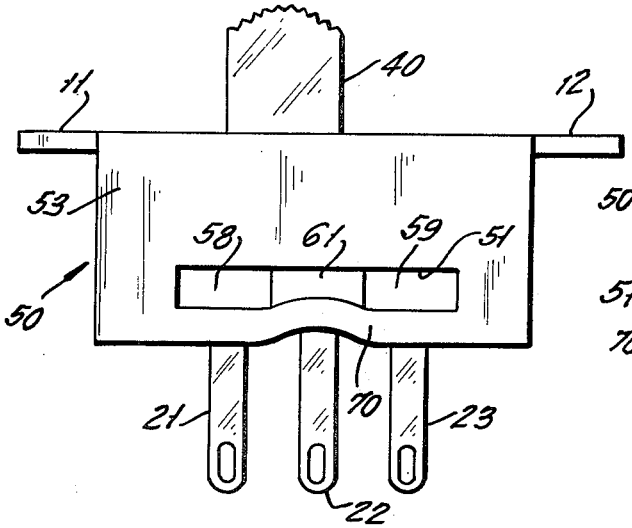
FIG. 14 is an elevation view of the housing of FIGS. 7 to 9 assembled with the switch terminal board of FIGS. 12 and 13 in accordance with the invention.
Figure 15:
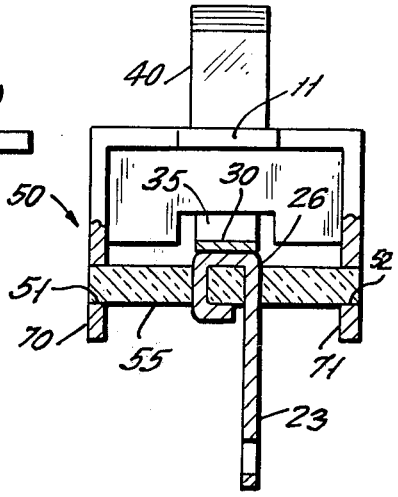
FIG. 15 is an end view of the switch of FIG. 14 shown partly in cross-section.

The interior components of the remainder of the switch are identical to those of FIGS. 1 to 6. Thus, as shown in the assembled switch of FIGS. 14 and 15, a sliding contact 30 and a biasing spring 35 are carried by insulation operating member 40 as was previously described. However, as shown in FIGS. 14 and 15, the terminal board 55 is more securely held within housing 50 and is held against separating forces by the tensile strength of the steel bridges at the ends of the slots 51 and 52.

In order to further secure the board 55 within the housing 50, the bottom sections 70 and 71 of housing 50 beneath slots 61 and 60 (FIGS. 14 and 15) can be upwardly deformed into slots 61 and 60, respectively, in order to laterally lock the tabs 56 to 59 in position.

If desired, and as shown in FIG. 10, the edges of slots 51 and 52 can be deformed outwardly before assembly of the switch in order to simplify the loading of the terminal board into the housing 50. After the board is assembled in position, the outwardly deformed edges of the slots 51 and 52 of FIG. 10 can be restored by an appropriate tool to a position where they are flat and planar with the remainder of the legs 53 and 54, respectively.

The housing of FIGS. 7 to 10 is shown with mounting ears 11 and 12. If desired, the housing can be modified as shown in FIG. 11, whereby the legs of the U-shaped housing are provided with extending tabs, such as the tabs 80 and 81 for one leg of the U, and similar tabs for the other leg of the U not shown in FIG. 10. These mounting tabs are then used to mount the switch to a printed circuit board or other mounting surface. Note, however, in FIG. 11, that slots such as slot 51 are still employed for receiving the switch terminal board in the manner shown in FIGS. 14 and 15.

Although the present invention has been described in connection with a preferred embodiment hereof, many variations and modifications will now become apparent to those skilled in the art. It is preferred, therefore, that the present invention be limited not by the specific disclosure contained herein, but only by the appended claims.

What is claimed is:

1. A switch assembly comprising a thin, flat, rectangular switch terminal board of insulation material; a plurality of stationary contacts fixed to one surface of said switch terminal board; a U-shaped housing of thin, rigid material having first and second flat legs and a bridging base member and mounting means for mounting said switch on a mounting surface; a movable contact assembly disposed atop said plurality of stationary contacts and within said housing and movable in sliding relationship with respect to said plurality of stationary contacts; an operating member fixed to said movable contact assembly and having a handle portion extending through said bridging base member and accessible for operation from regions external of said U-shaped housing; said first and second flat legs of said housing having respective first and second parallel elongated slots extending therethrough which are parallel to and adjacent the respective free ends of said flat legs; said flat switch terminal board having first and second parallel edges which are disposed in said first and second slots respectively; said first and second edges terminating generally flush with the outer surfaces of said first and second flat legs respectively; said switch terminal board holding said movable contact assembly and said operating handle in place within said U-shaped housing and resisting forces produced by said movable contact assembly and said operating member; said first and second edges of said switch terminal board having respective central notches; the material in the webs between said free ends of said first and second legs and said first and second slots respectively being deformed into said central notches of said first and second legs respectively.

2. A switch assembly comprising a thin, flat, rectangular switch terminal board of insulation material; a plurality of stationary contacts fixed to one surface of said switch terminal board; a U-shaped housing of thin, rigid material having first and second flat legs and a bridging base member and mounting means for mounting said switch on a mounting surface; a movable contact assembly disposed atop said plurality of stationary contacts and within said housing and movable in sliding relationship with respect to said plurality of stationary contacts; an operating member fixed to said movable contact assembly and having a handle portion extending through said bridging base member and accessible for operation from regions external of said U-shaped housing; said first and second flat legs of said housing having respective first and second parallel elongated slots extending therethrough which are parallel to and adjacent the respective free ends of said flat legs; said flat switch terminal board having first and second parallel edges which are disposed in said first and second slots respectively; said first and second edges terminating generally flush with the outer surfaces of said first and second flat legs respectively; said switch terminal board holding said movable contact assembly and said operating handle in place within said U-shaped housing and resisting forces produced by said movable contact assembly and said operating member; the parallel edges of each of said first and second slots being deformed outwardly relative to the plane normally containing said first and second legs respectively to simplify the loading of said switch terminal board into said U-shaped housing.

3. The switch assembly of claim 1 or 2, wherein said housing is bent to shape from a stamped flat sheet of steel having a thickness of less than about 25 mils.

* * * * *